United States Patent [19]

Nakajima et al.

[11] 4,194,108

[45] Mar. 18, 1980

[54] THERMAL PRINTING HEAD AND METHOD OF MAKING SAME

[75] Inventors: Takashi Nakajima, Chiba; Katsuto Nagano, Yokohama; Kazumi Ishikawa, Chiba, all of Japan

[73] Assignee: TDK Electronics Co., Ltd., Tokyo, Japan

[21] Appl. No.: 870,417

[22] Filed: Jan. 18, 1978

[30] Foreign Application Priority Data

Jan. 20, 1977 [JP] Japan ..... 52/5251

[51] Int. Cl.[2] ..... H05B 1/00

[52] U.S. Cl. ..... 219/216; 29/611; 29/620; 219/543; 338/308; 338/309; 346/76 PH; 357/61; 357/63

[58] Field of Search ..... 219/216, 543; 346/76 PH; 357/28, 61, 63; 29/611, 620, 621, 624; 338/308, 309, 307; 252/518; 427/101, 102

[56] References Cited

U.S. PATENT DOCUMENTS

| | | | |
|---|---|---|---|
| 3,161,457 | 12/1964 | Schroeder et al. | 346/76 |
| 3,210,624 | 10/1965 | Williams | 357/61 X |
| 3,478,191 | 11/1969 | Johnson et al. | 219/216 |
| 3,578,946 | 5/1971 | Colello | 219/543 |
| 3,813,513 | 5/1974 | Vora et al. | 219/216 |
| 3,814,897 | 6/1974 | Otani et al. | 219/543 X |
| 3,877,060 | 4/1975 | Shono et al. | 357/61 X |

*Primary Examiner*—C. L. Albritton

*Attorney, Agent, or Firm*—Leydig, Voit, Osann, Mayer & Hoyt, Ltd.

[57] ABSTRACT

A thermal printing head for printing alphanumeric characters on a thermally-responsive medium, the head being faced with a pattern of heat generating "dot" elements electrically insulated from one another and having conductive leads, with means for connecting the leads selectively to a source of electric current. The heat generating elements are formed of a film of boron phosphide. Preferably the leads are also formed of boron phosphide, integral with the elements, but "doped" to secure a high degree of conductivity. The printing head is formed by applying a boron phosphide compound on a substrate, covering the same with a passivation film, removing the passivation film to expose a background area of the compound film defining a central "island" of unexposed area, doping the exposed background area to increase the conductivity thereof, removing the passivation film from the island, and forming grooves in the compound film dividing the island into separate heat generating elements, with the grooves extended into the background area to form pairs of integral conductive leads for the elements.

8 Claims, 21 Drawing Figures

APPLY BP FILM TO SUBSTRATE

SUPERIMPOSE PASSIVATION FILM

PHOTO-ETCH TO EXPOSE BACKGROUND AREAS OF BP FILM

DOPE EXPOSED AREAS TO MAKE HIGHLY CONDUCTIVE

REMOVE REMAINING PASSIVATION FILM

FORM GROOVES TO DEFINE RESISTIVE DOTS.

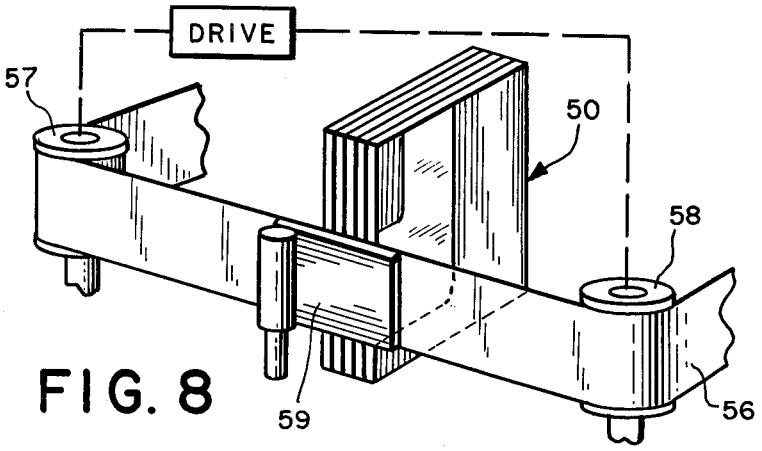
FIG. 8
FIG. 9
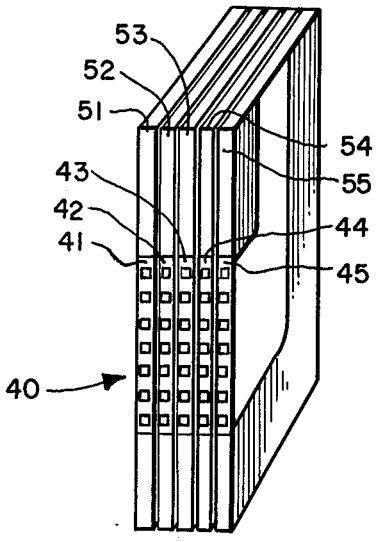
FIG. 10A
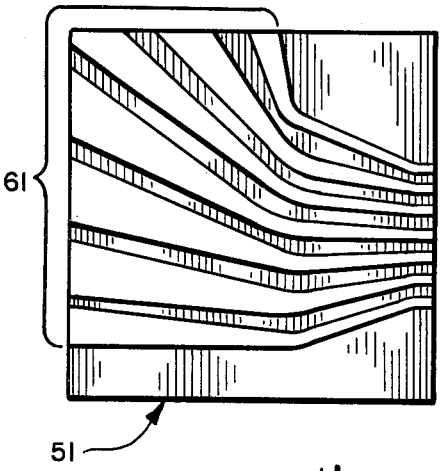
FIG. 10C
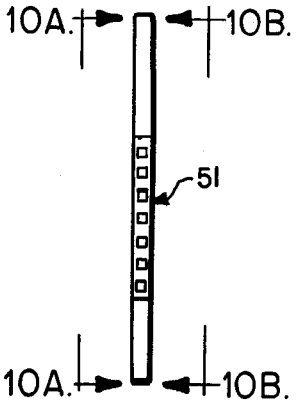
FIG. 10B
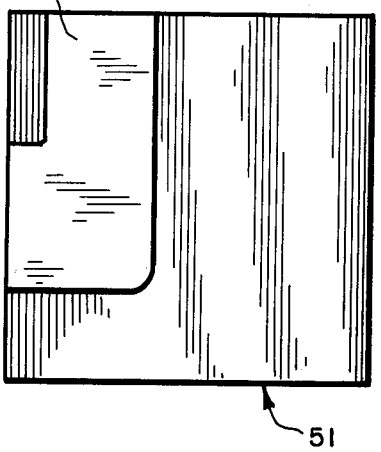
FIG. 12
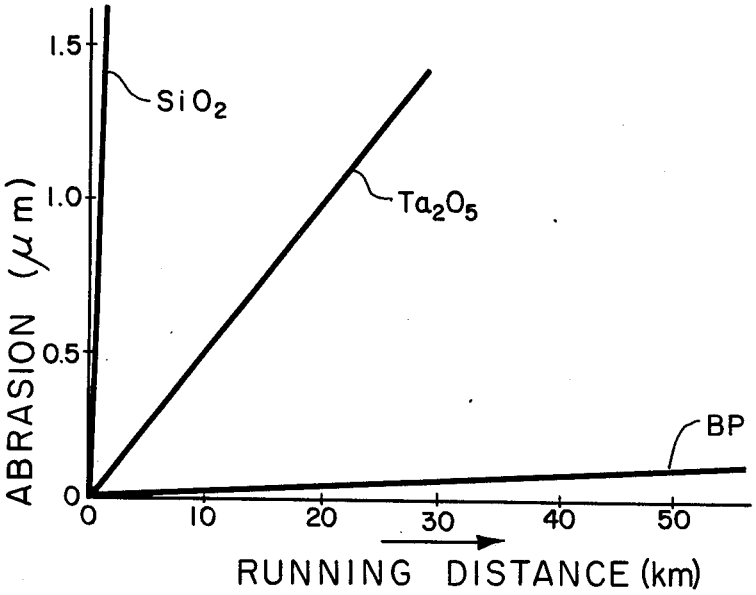

THERMAL PRINTING HEAD AND METHOD OF MAKING SAME

The utilizable speed of an electronic computer is almost invariably limited by the speed of the associated print-out mechanism. Printers in common use are mostly of the mechanical type having a speed which is inherently limited by the inertia of the mechanical printing elements. To improve the speed of print-out, and to avoid the high noise level usually associated with mechanical printers, attention has recently been given to the development of thermal printing heads acting upon a sheet or strip of thermally sensitive paper. To achieve low thermal inertia and high localized temperatures, thermal heads have utilized semiconductor films of silicon, cermet, tin oxide, titanium nitride, tantalum nitride and the like, but such materials must be considered unsatisfactory because of limited abrasion resistance and therefore short useful life.

To improve abrasion resistance efforts have been made to develop surface protective coatings, for example, a coating of tantalum oxide on an element formed of tantalum nitride. Such efforts have been largely self-defeating, however, since the coatings interfere with thermal efficiency, tending to insulate the print-out medium from the element and causing dispersion of the heat laterally in the plane of the coating resulting in loss of definition. An increase in heat rate does not improve the situation.

It is, accordingly, an object of the present invention to provide an improved thermal printing head employing a film of boron phosphide compound as the heat generating element, thereby achieving a combination of advantages providing an ideal solution to the problems which have been encountered in the past.

More specifically it is an object to provide a novel thermal printing head having an extremely high abrasion resistance and which does not, therefore, require resort to a protective coating. It is another object of the present invention to provide a thermal printing head which, upon receiving an energizing pulse, achieves almost instantaneously an extremely high level of temperature and which immediately restores itself to the cool state, thereby to produce clean and precise print-out at a high printing rate. It is a related object to provide a thermal printing head which has a high degree of stability and which can withstand, almost indefinitely, repeated cycles of heating and cooling.

It is another object of the invention to provide a thermal printing head in which, during manufacture, the electric resistance is adjustable over a wide range thereby adapting the head to various types and designs of energizing matrices.

It is still another object of the invention to provide a thermal printing head which overcomes the usual "termination" problem and in which the electrical supply leads are integral with, and thus securely connected to, the thermal element, being formed of the same material as the thermal element, but doped to achieve high thermal conductivity. It is, finally, an object of the invention to provide a method of making a thermal printing head which is highly economical and well adapted to quantity production techniques.

Other objects and advantages of the invention will become apparent upon reading the attached detailed description and upon reference to the drawings in which:

FIG. 8 shows a head employing the present invention acting upon a thermally sensitive medium.

FIG. 9 is an enlarged perspective view of the head of FIG. 8.

FIGS. 10A and 10B show opposite sides of one of the head laminations while FIG. 10C is an edge view thereof.

FIG. 12 is a plot showing the improved wearing qualities characteristic of a film of boron phosphide.

Figure 1A:
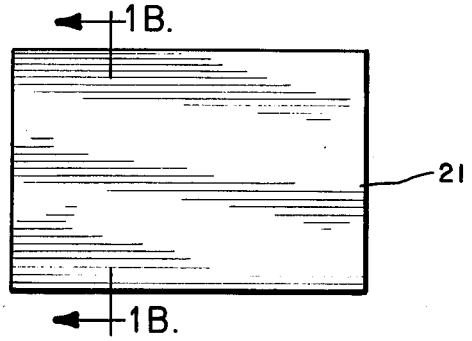
FIGS. 1A and 1B are face and cross sectional views, respectively, showing a substrate with an applied boron phosphide film.
Figure 1B:
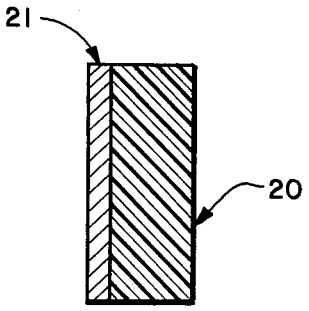

While the invention has been described in connection with certain preferred embodiments, it will be understood that we do not intend to be limited by the particular embodiments disclosed herein but we intend, on the contrary, to cover the various alternative and equivalent constructions included within the spirit and scope of the appended claims.

Referring now to the drawings, there is set forth in FIGS. 1 through 6 the steps employed in the present invention for converting a blank into a printing head having localized, selectively energizeable thermal elements. Referring first to FIGS. 1A, 1B, a workpiece or substrate 20 is used which may, for example, be in the form of a pure, inert and monolithic chip of silicon, sapphire, spinel, silicon oxide, alumina or the like or a double layer substrate consisting of layers of different ones of them such as, for example, a silicon-on-sapphire (SOS) substrate. The substrate 20 may have a thickness of approximately 0.3 mm, a width of 3.4 mm and a length of 8.1 mm, the face being polished to a mirror-like finish.

A thin film 21 of boron phosphide is first deposited upon the face of the substrate 20 of, for example, silicon, employing epitaxial growing techniques to a thickness on the order of 0.5$\mu$.

Figure 2A:
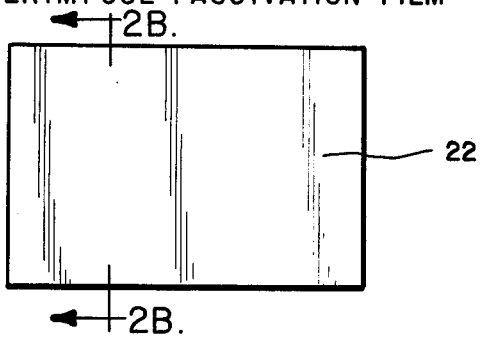
FIGS. 2A and 2B are corresponding views showing superimposition of a passivation film.
Figure 2B:
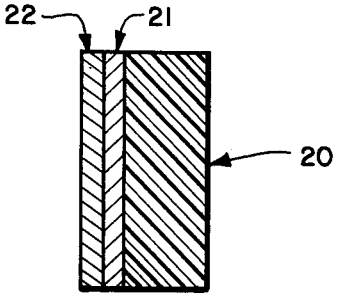

For the purpose of shielding or "passivating" selected portions of the boron phosphide film during subsequent steps, a passivating layer 22 is superimposed upon the film 21, as shown in FIGS. 2A, 2B. Such layer is preferably formed of $SiO_2$ with use of electrical sputtering techniques or growth in the gaseous phase to produce a layer of approximately 2,000 to 3,000 Å in thickness.

Figure 3A:
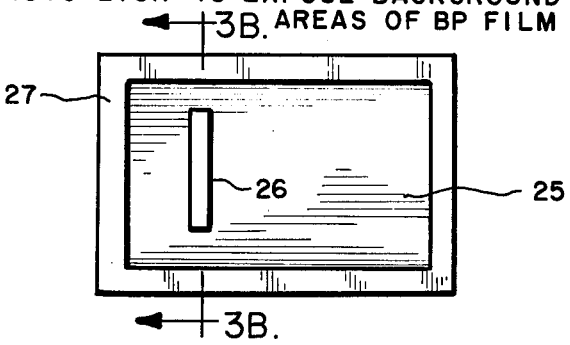
FIGS. 3A and 3B show removal of the passivation film to expose a background area defining a protected central island.
Figure 3B:
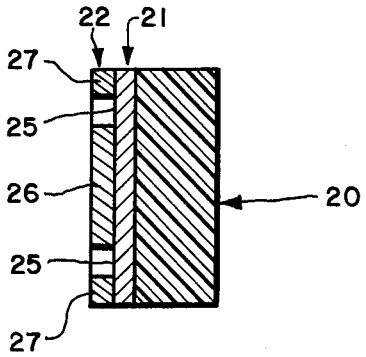

In the subsequent step, illustrated in FIGS. 3A, 3B the passivation layer is selectively photo-etched, that is to say removed, over a background area 25 from which electrically conductive leads are to be subsequently formed, the exposed background area 25 defining a central "island" 26 which is unexposed (remains protected) and which subsequently is utilized as the active area from which the thermal elements are formed. In addition to the unexposed island area 26 there may be an unexposed peripheral, or picture frame, area 27.

Figure 4A:
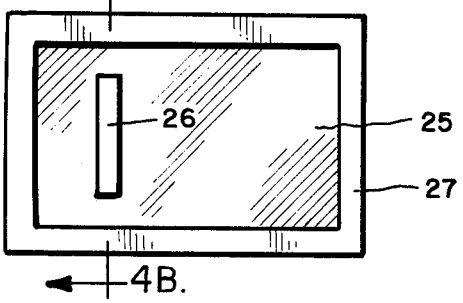
FIGS. 4A and 4B illustrate the doping of the exposed area for conductivity.
Figure 4B:
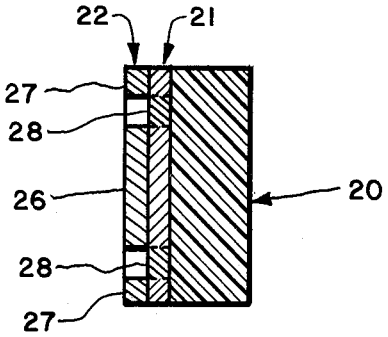

The next step, illustrated in FIGS. 4A, 4B, is the "doping" of the exposed background area 25. This is accomplished through conventional solid state doping techniques using an impurity such as selenium (Se) or tellurium (Te), with the process being carried to the degree which causes the resistivity of the boron phosphide to be reduced to about $10^{-4}$ to $10^{-2}$ ohm-centimeters. Conversely stated, the film is doped to such degree that the treated area becomes highly conductive and therefore suitable for use as integral connecting leads. The region of increased conductivity is indicated by the "reversed" crosshatching 28 (FIG. 4B). Using the above sapphire substrate, doping is achieved by keeping the workpiece at a temperature within the range of 850 to 1150 degrees C. within a silicon tube. Hydrogen gas with the addition of a slight amount of $H_2Se$ or $H_2Te$ gas in a range of 100–500 ppm is flowed through the tube at a rate of about 10 meters per minute, whereby Se or Te is diffused in the gaseous phase into the boron phosphide. The process is monitored to control the donor impurity concentration and hence the conductivity of film in the exposed area.

Figure 5A:
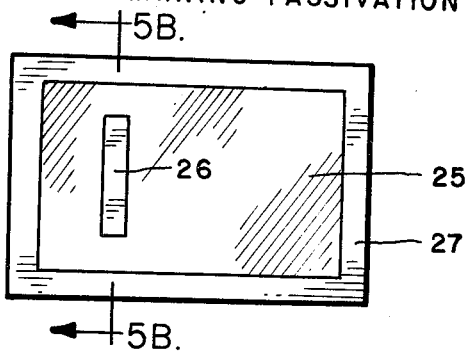
FIGS. 5A and 5B show removal of the remaining passivation film.
Figure 5B:
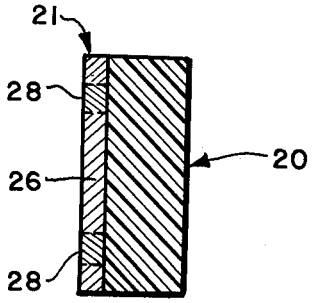

After the area 25 has been rendered conductive, the remaining passivation film covering the area 26, 27 is removed. This is done by dipping the workpiece into an etching reagent solution of HF and $NH_4F$. As illustrated in FIG. 5B, this removes the protection previously afforded the active or island area 26 as well as the area 27.

Figure 6A:
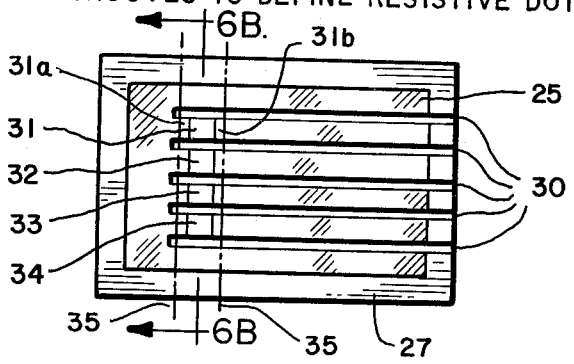
FIGS. 6A and 6B show the formation of grooves to define resistive dots, with the grooves being extended into the background area to form pairs of conductive leads.
Figure 6B:
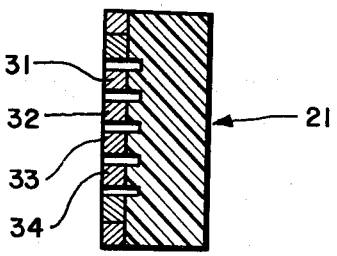

As a next step in the procedure illustrated in FIGS. 6A, 6B, a plurality of parallel isolating grooves 30 are formed in the film to divide the island 26 into separate resistive heat generating elements here indicated at 31–34, the grooves 30 extending on opposite sides of the island and into the conductive background area 25 to form pairs of conductive leads, for example, the leads **31*a*, 31*b* which are integral with and which provide a current flow path to the heat generating element 31. The parallel grooves 30** are preferably formed by a photo-engraving process in which a resist is applied over the face of the workpiece, with the groove area, only, remaining exposed. The face of the workpiece is then plasma-etched with $CF_4$ gas, following which the resist is removed.

The product shown in FIGS. 6A and 6B may be directly employed as a rudimentary printing head, with the dots 31–34 forming a vertical row being selectively energized via the corresponding low-resistance leads defined by the grooves 30. However, where a printing head having a stacked matrix arrangement is required, the workpiece is cut up, in part along lines 35 (FIG. 6A), to provide separate heat generating elements having a size of 0.2 by 0.3 mm. and a thickness of 0.3 mm. A complete field is formed by the stacking of 35 individual elements in five columns, each seven lines long, with the individual elements insulated from one another. Such field is capable, upon selective energization, of forming any desired alphanumeric character.

In a practical case the grooves 30 may be approximately 60μ wide and 1μ deep spaced to produce heat generating elements, and associated leads, having a width of 260μ.

It is one of the features of the present invention that the central island 26 defined by the passivation layer is in the form of a straight relatively narrow and longitudinally extensive strip which may, for example, measure 260μ in width and having a length which is dependent upon the number of lines desired in a column.

Figure 7A:
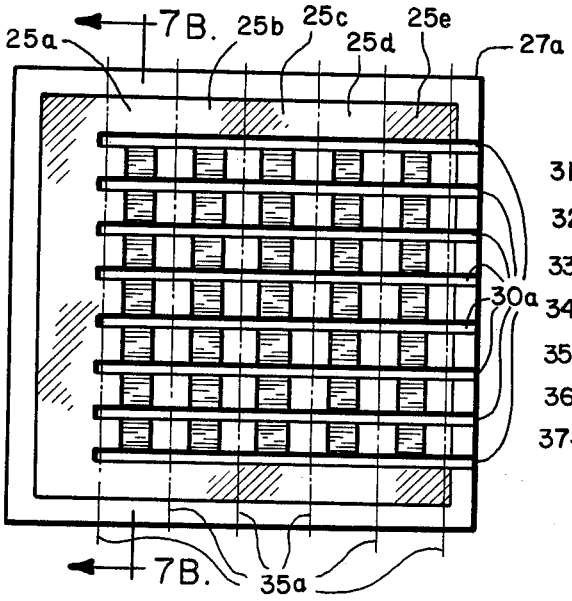
FIGS. 7A and 7B show a substrate having grooves intersecting a plurality of islands.
Figure 7B:
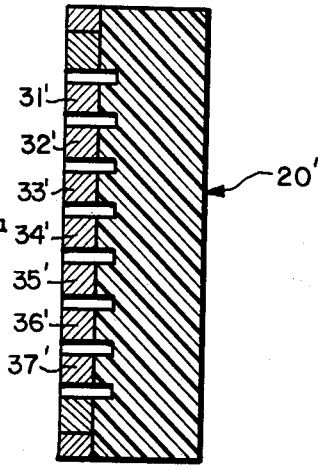
Figure 7C:
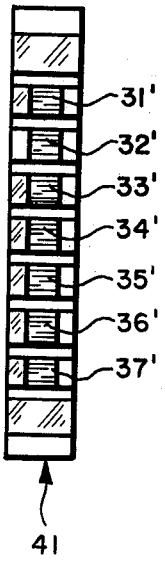
FIG. 7C shows a strip or slug cut from the substrate illustrated in the preceding figures.

For a typical printer employing a 5×7 format, and having a total of seven lines, the island may be extended to the dimension illustrated in FIG. 7B in which the heat generating elements are indicated at 31'–37' and in which other corresponding parts are indicated by reference numerals with addition of subscript a. Moreover, the present invention contemplates using a workpiece having a plurality of central islands arranged parallel to one another and occupying the positions indicated at **25*a*–25*e*, all of the islands being simultaneously intersected by the set of grooves 30*a*. Subsequently, the workpiece is cut along lines 35*a* (FIG. 7A) with appropriate allowance for width of kerf, to produce individual vertical slugs seven lines high as indicated at 41 in FIG. 7C**. Five of such slugs mounted side by side produce a complete two-dimensional alphanumeric field.

For the purpose of making electrical contact with the leads of each heat generating element, and for the convenient bringing out of a total of 35 selectable electrical contacts, plus ground, five vertical slugs 41–45 forming a dot field 40 may be mounted upon a support assembly 50 made up of laminated conforming layers 51–55 (FIG. 9) having the vertical slugs respectively fixed to the front edges. The printing, or dot, field thus formed is engaged by a moving recording medium which, for example, may be in the form of a tape 56 of thermally sensitive paper, such as that sold by the 3M Company, Minneapolis, Minn. U.S.A., under the trademark THERMOFAX, the tape being trained about driven spools 57, 58. The tape is maintained in pressure engagement with the head by means of a resilient backstop 59.

Figure 11:
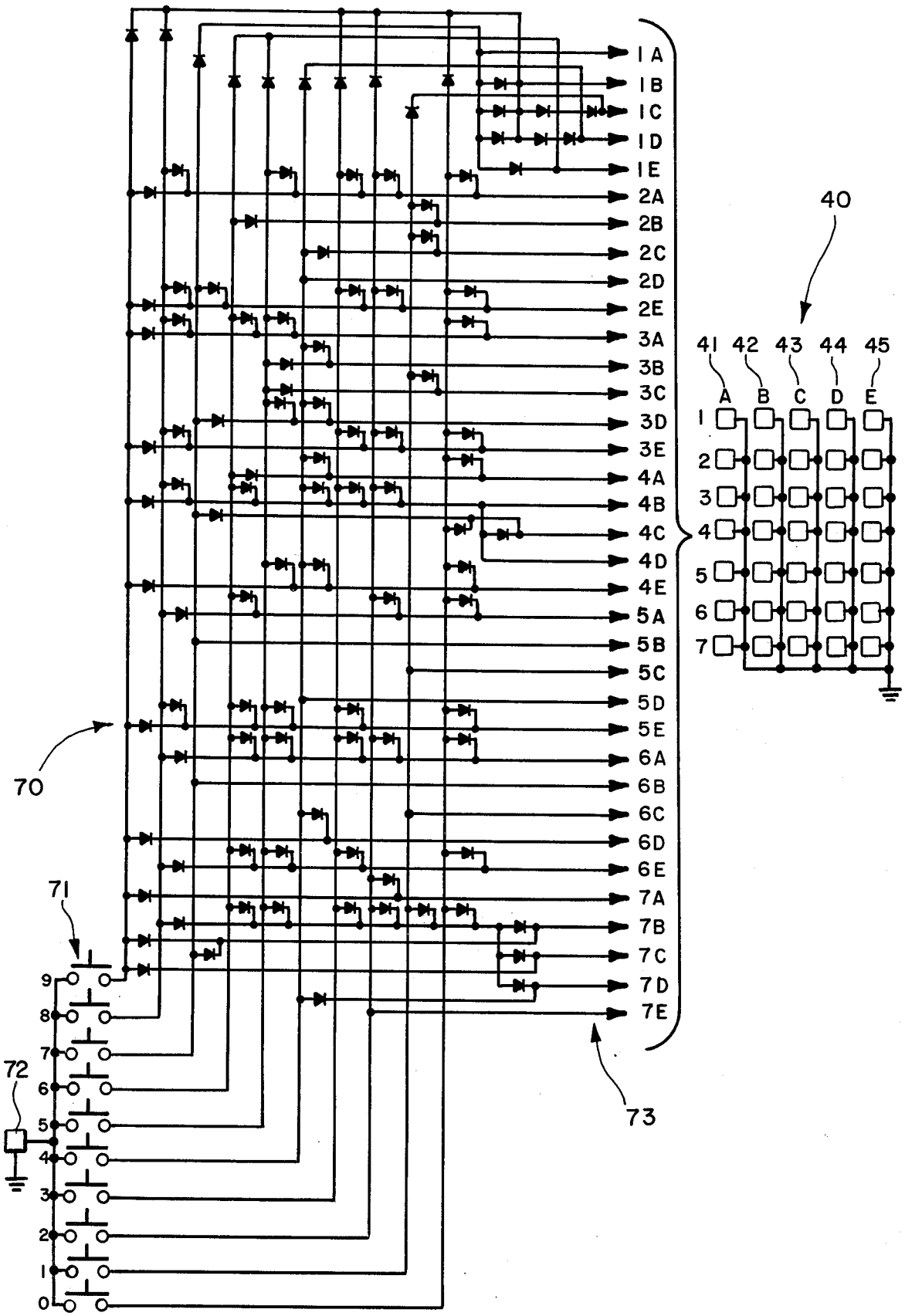
FIG. 11 shows a typical energizing matrix suitable for use with the head of FIG. 9.

For the purpose of establishing electrical contact with individual ones of the generating elements comprising a slug, each of the laminar supports 51–55 has a printed circuit formed on its opposite sides. The conducting leads, seven in number, on the side illustrated in FIG. 10A are collectively indicated at 61 whereas the common ground connection, on the other side of the laminate is indicated, in FIG. 10B, at 62. It will be understood that the layers 51–55 are separated from one another by a suitable insulating film. For energizing the heat generating elements, an electrical diode, or logic, matrix is used, as is well known to one skilled in the art. A representative matrix, capable of numeric representation, is set forth at 70 in FIG. 11. Simply by way of example it includes an input circuit represented by a set of pushbuttons connected to a source of direct voltage pulses 72. Diodes connected in a logical array feed a set of 35 output lines 73 which are connected to corresponding heat generating elements forming the field 40. The output lines are keyed by line number and row letter to particular positions within the field.

It will be apparent to one skilled in the art that the lines shown connected to pushbuttons will, in practice, be coupled to the output of a computer for momentary closure of the input circuits in a sequence automatically directed by the computer and at a high rate of speed, with printing taking place "on the fly" as the recording medium 56 advances past the recording head.

It will also be apparent to one skilled in the art that while a simplified form of diode matrix has been illustrated, more elaborate output circuitry may be employed including capacitor discharge using circuits of short time constant. The resistance of the heat generating elements may be varied over a wide range, permitting the head to be designed for optimum operation with designed energy content and designed source impedance. Thus the film may be of any optional thickness ranging from several hundred Å, to several tens of microns simply by carrying the gaseous phase growth to the desired degree. Regardless of thickness, the design temperature is reliably high, for example, on the order of 500° C. Such temperatures can be readily withstood by boron phosphide whose melting point is not reached until about 3000° C. The compound is known to be chemically and physically stable over a temperature range of up to at least 1000° C. A high degree of thermal reliability is therefore achieved.

In the above discussion the compound boron phosphide has been considered in a generic sense to include compounds generally represented by a formula $B_xP_y$. Boron phosphide suitable for deposition by epitaxial growth techniques are commercially available having a range of x and y values. Our studies show, however, that it is preferable to use boron phosphide compounds in which the ratio of x to y lies within the range of 0.5 to 7.5. The preferred ratio is unity, for example, as represented by the formula $B_{0.5}P_{0.5}$.

While the thickness of the deposited film, and the choice of the boron phosphide compound provide a wide range of design resistance, the resistance may be adjusted, in addition, by slight doping of the heat generating element. Such doping may be carried out as described in connection with FIGS. 4A, 4B as a seperate step just preceeding FIGS. 6A, 6B, but with the doping process stopped short of the level in which good conductivity is achieved. In this way it has been found possible to control the resistivity of the heat generating elements over a range of $10^{-4}$ to $10^{+10}\Omega$cm.

Experience shows that boron phosphide has a sufficient hardness to provide great abrasion resistance resulting in an operating life which exceeds many times over that of more conventional materials. Tests show a Vickers hardness of 4,700 kg/cm$^2$ which exceeds that of even such a hard material as sapphire which has a Vickers hardness of 2.250 kg/cm$^2$. In an abrasion test, thermally sensitive recording paper was pressed against a thermal printing head of present design under a pressure of 200 g/cm$^2$. A total travel of a distance exceeding 45 kilometers resulted in a total abrasion of less than 0.1 μm. A comparison with typical abrasion characteristics of alternate materials, namely $SiO_2$ and $Ta_2O_5$ shows (FIG. 12) the dramatic nature of the improvement.

While it is preferred to employ leads for the heat generating elements which are integral with the boron phosphide heat generating elements and which are formed of doped boron phosphide to provide high conductivity, (e.g., leads 31*a*, 31*b* associated with element 31 in FIG. 6A), the invention is not limited thereto and other lead materials may be substituted. Such alternate materials include films of copper, silver, aluminum, titanium, molybdenum, tungsten, chromium, gold, platinum, tantalum, or the like, either as a single material or in multiple layers of combined materials, the deposition of the leads on the substrate being a matter well within the skill of the art.

What we claim is:

1. A thermal printing head comprising an electrically insulative substrate, a pattern of heat generating elements formed on a surface of said substrate and electrically insulated from one another, and means for selectively flowing an electric current to said heat generating elements to heat selected ones of the elements, said heat generating elements consisting substantially of a boron phosphide compound.

2. A thermal printing head according to claim 1 wherein said boron phosphide compound is of a composition $B_xP_y$ in which the ratio of x to y lies within the range of 0.5 to 7.5.

3. A thermal printing head according to claim 1 wherein said boron phosphide compound is $B_{0.5}P_{0.5}$.

4. A thermal printing head according to claim 1 wherein said substrate is of a material selected from a group consisting of silicon, sapphire, spinel, silicon oxide alumina, the group also including double layers of different ones of them.

5. A thermal printing head according to claim 1 wherein said current flowing means comprises a plurality of pairs of input and output leads connected to respective heat generating elements and a matrix of switching elements connected to respective pairs of said leads, said leads consisting substantially of said boron phosphide compound to which an impurity for lowering the resistivity of the compound is added.

6. A thermal printing head according to claim 5 wherein said lowered resistivity of the compound is in the range of $10^{-4}$ to $10^{-2}\Omega$cm.

7. A thermal printing head according to claim 1 wherein said current flowing means comprises a plurality of leads connected to respective heat generating elements and a matrix including a plurality of switching elements connected to respective ones of said leads, said leads being made from at least one of the group consisting of copper, silver, aluminum, titanium, molybdenum, tungsten, chromium, gold, platinum and tantalum.

8. A thermal printing head according to claim 5 wherein said impurity is selected from a group consisting of selenium and tellurium.

* * * * *